United States Patent [19]

Dupuis

[11] Patent Number: 4,819,964

[45] Date of Patent: Apr. 11, 1989

[54] COMBINATION BOOK JACKET COVER

[76] Inventor: Emmanuel Dupuis, 21 Prince Philip Drive, St. Catherines, Ontario, Canada, L2N 3H9

[21] Appl. No.: 195,605

[22] Filed: May 18, 1988

[51] Int. Cl.[4] ..... B42D 3/00; B42D 1/00; B42D 9/00; B42D 15/00

[52] U.S. Cl. ..... 281/35; 281/42; 281/21.1; 283/81

[58] Field of Search ..... 281/2, 19 R, 21 R, 31, 281/34, 35, 41, 42, 33, 36; 283/81; 428/40; 229/68 R

[56] References Cited

U.S. PATENT DOCUMENTS

| | | | |
|---|---|---|---|
| 4,412,692 | 11/1983 | Williams | 281/34 |
| 4,479,838 | 10/1984 | Dumsirn | 283/81 |
| 4,558,888 | 12/1985 | Hanson et al. | 281/21 R |
| 4,568,108 | 2/1986 | Simpson | 281/2 |
| 4,589,685 | 5/1986 | Lazar | 283/81 |
| 4,679,823 | 7/1987 | Magy | 281/42 |

FOREIGN PATENT DOCUMENTS

| | | | |
|---|---|---|---|
| 1537674 | 1/1979 | United Kingdom | 281/35 |

*Primary Examiner*—Frank T. Yost
*Assistant Examiner*—Paul M. Heyrana, Sr.
*Attorney, Agent, or Firm*—Walter F. Wessendorf, Jr.

[57] ABSTRACT

A combination book jacket cover is removably secured to a book via transparent jacket-tapes to project the book and to prevent the book's hard covers from pulling out of the jacket cover's end flaps upon the book's back or spine being flexed, or from sliding up or down, thereby preventing tear or damage of the jacket cover, or damage to the book's hard covers and back. The jacket-tapes have adhesively coated end portions that are removably engaged with corresponding top and bottom portions of the jacket cover and end flaps.

2 Claims, 1 Drawing Sheet

COMBINATION BOOK JACKET COVER

BACKGROUND OF THE INVENTION

1. Technical Field

This invention relates to a combination book jacket cover that can be removably secured to a book to protect the book and to prevent the book's hard covers from pulling out of the jacket cover's end flaps, or from sliding up or down, thereby preventing tear or damage to the jacket cover or to the book's hard covers or back.

2. Background

A new book is usually sold with a jacket cover of one-piece hard paper, or other suitable material. The jacket cover covers the area corresponding to the book's exterior sides or hard covers and its back or spine. The jacket cover's end flaps are inserted within the book against the interior portions of the hard covers. The jacket cover serves not only to protect the book's hard covers and back from damage, but also the jacket cover is usually colorful and promotional, and, as such, is much esteemed by the book's owner. The problem in the art is that when one opens the book and holds same in one's hands or flexes the book's spine, the book's hard covers pull out of the end flaps or the jacket cover slides up or down, with the result that the jacket cover is thereby subjected to tear or damage, as well as the hard covers so being subjected to damage. The hook's owner is annoyed at having to continually replace the jacket cover and reinsert the end flaps.

SUMMARY OF THE INVENTION

Accordingly, the object of this invention is to contribute to the solution of the discussed problems in the art by providing a combination book jacket cover and removable jacket-tapes. The book jacket cover is of one-piece construction and made from hard paper or other suitable material. The jacket cover covers the area corresponding to the book's hard covers and back. The jacket cover has folded-over end flaps which are inserted within the book and against the interior portions of the hard covers. Four transparent jacket-tapes have adhesive end portions and non-adhesive middle portions. The jacket-tapes have their middle portions engaged with the top and bottom edges of the book's hard covers. The adhesive end portions of the jacket-tapes are removably engaged with the exterior top and bottom portions of the jacket cover, and with the top and bottom portions of the end flaps. The jacket-tapes thusly are adhesively engaged with the jacket cover and end flaps sufficient distances from the lateral edges of the book's hard covers to removably secure the jacket cover to the book and to prevent the hard covers from pulling out of the end flaps upon the book's back or spine being flexed.

BRIEF DESCRIPTION OF THE DRAWINGS

This object and other objects of the invention should be discerned and appreciated from the description of the preferred embodiment taken in conjunction with the drawings, wherein like reference numerals refer to similar parts throughout the several views, in which.

DESCRIPTION OF THE PREFERRED EMBODIMENT

Figure 1:
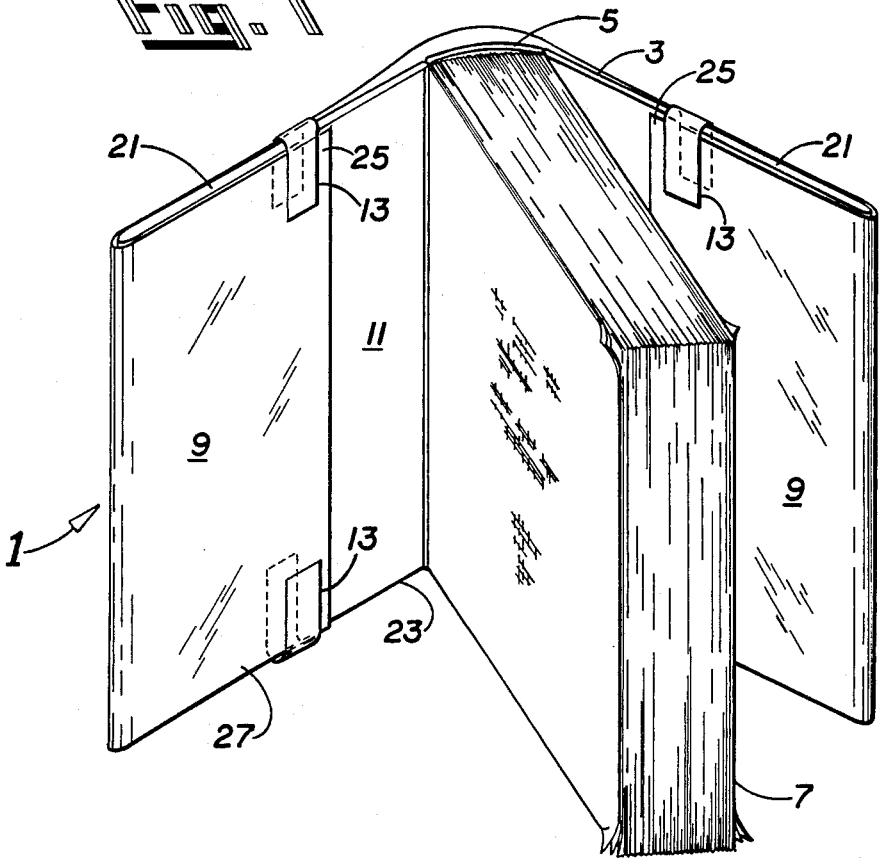
FIG. 1 is a perspective view showing the combination book jacket cover mounted on a book and removably secured thereto by means of the transparent jacket-tapes.
Figure 3:
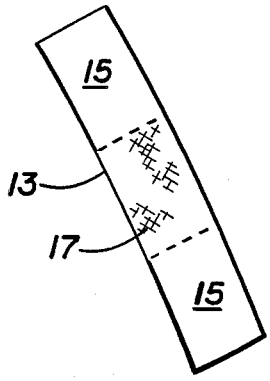
FIG. 3 is a view of a jacket-tape with the tabs removed.
Figure 2:
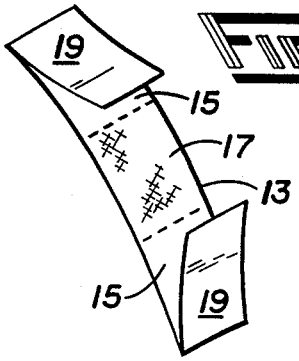
FIG. 2 is a view of a jacket-tape preparatory to removing the tabs covering the adhesive end portions.

In FIG. 1 of the drawings, reference numeral 1 generally refers to the combination book jacket cover. Jacket cover 1 covers the area corresponding to the exterior portions of the hard covers 3 and back 5 of the book 7, and is disposed in superposed relationship therewith. The jacket cover 1 has end flaps 9 disposed in superposed relationships against the interior portions 11 of the hard covers 3 of the book 7. Four transparent jacket-tapes 13 removably secure the jacket cover 1 to the book 7. Each jacket-tape 13 has end portions 15 and a non-adhesive middle portion 17. Only one side of the end portions 15 are coated with an adhesive substance. Removable tabs 19 cover the adhesive-coated sides of the end portions 15. The transparent jacket-tapes 13 are appropriately manipulated to partially remove the tabs 19, as shown in FIG. 2; then the jacket-tapes 13 are appropriately disposed such that their non-adhesive middle portions 17 are centered upon the top and bottom edges 21 and 23 of the hard covers 3; and then the jacket-tapes 13 are further appropriately manipulated such that, as the tabs 19 are being removed, the adhesive coated sides of the end portions 15 will appropriately engage the top and bottom portions 25 and 27 of the end flaps 9 and the corresponding exterior top and bottom portions of the jacket cover. The jacket-tapes 13 are adhesively engaged with the top and bottom portions of the jacket cover and end flaps sufficient distances from the lateral edges of the book's hard covers 3 to prevent the hard covers 3 from pulling out from the end flaps 9 upon the back or spine 5 of the book 7 being flexed. The jacket cover can be removed without damage from the book. However, to remove the jacket cover, the adhesive end portions of the jacket-tapes must first be manipulatively lifted off and freed from either the end flaps or from the jacket cover.

I claim:

1. A combination book jacket cover removably secured to a book to protect the book and to prevent the book's hard covers from pulling out of the jacket cover's end flaps upon the book's back or spline being flexed, or from sliding up or down, thereby preventing tear or damage of the jacket cover, or the book's hard covers and back; said combination book cover jacket comprising a book jacket cover and jacket-tapes; said book jacket cover being of one-piece construction and being made of hard paper, said jacket cover having exterior top and bottom portions, said book having hard covers and a back, said hard covers having exterior portions, said book jacket covering the area corresponding to said exterior portions of said hard covers and back, said jacket cover being disposed in superposed relationship with said hard covers, said book's hard covers having interior portions, and jacket cover having end flaps, said end flaps being disposed in superposed relationship upon said interior portions of said book's hard covers, said jacket-tapes having end portions and non-adhesive middle portions, each of said end portions of said jacket-tapes having a side adhesively coated, said hard covers of said book having top edges and bottom edges, said non-adhesive middle portions of said jacket-tapes being engaged with said book's top and bottom edges, said end flaps having top and bottom portions, said adhesively coated sides of said end portions flaps of said jacket-tapes being engaged with said top and bottom portions of said end flaps and with said exterior top and bottom portions of said jacket cover, said hard covers jof said book having lateral edges, said adhesively coated sides of said end portions of said jacket-tapes being engaged with said top and bottom portions of said jacket cover and end flaps at sufficient distances from said lateral edges of said book's hard covers to prevent said book's hard covers from pulling out from said end flaps upon said back or spine of said book being flexed.

2. A combination book jacket cover in accordance with claim 1, wherein said jacket-tapes are transparent.

* * * * *